United States Patent [19]

Schuman

[11] 4,132,505

[45] Jan. 2, 1979

[54] THERMOCOMPRESSOR UTILIZING A FREE PISTON COASTING BETWEEN REBOUND CHAMBERS

[76] Inventor: Mark Schuman, 101 G St., SW., Apt. 516, Washington, D.C. 20024

[21] Appl. No.: 830,140

[22] Filed: Sep. 2, 1977

Related U.S. Application Data

[63] Continuation of Ser. No. 718,162, Aug. 27, 1976, abandoned, which is a continuation-in-part of Ser. No. 592,895, Jul. 3, 1975, Pat. No. 4,012,910.

[51] Int. Cl.[2] ..... F04B 19/24

[52] U.S. Cl. ..... 417/207; 60/520; 417/375

[58] Field of Search ..... 417/207, 375; 60/520

[56] References Cited

U.S. PATENT DOCUMENTS

| | | | |
|---|---|---|---|
| 3,274,795 | 9/1966 | Fowle et al. | 417/417 X |
| 3,767,325 | 10/1973 | Schuman | 417/207 |
| 3,782,859 | 1/1974 | Schuman | 417/207 |
| 3,807,904 | 4/1974 | Schuman | 417/207 |
| 4,012,910 | 3/1977 | Schuman | 417/207 X |
| 4,072,010 | 2/1978 | Schuman | 417/207 X |

*Primary Examiner*—Carlton R. Croyle
*Assistant Examiner*—Leonard E. Smith
*Attorney, Agent, or Firm*—Schwartz & Weinrieb

[57] ABSTRACT

A thermocompressor is disclosed as including a free piston which coasts upwardly and downwardly in a bypass region of a cylinder between cold and hot rebound chambers at cold and hot ends of the cylinder located at the top and bottom of the cylinder. A compressible fluid alternately flows downwardly and upwardly between the cold and hot cylinder ends via the cylinder bypass in response to the alternate upward and downward coasting of the piston. This alternate fluid flow, in conjunction with a thermal lag heating chamber, regenerator, and cooling chamber, causes an alternate heating and cooling of the fluid which produces a cyclical fluid pressure variation utilizable for driving a load. Although the regenerator, and generally the cooling chamber, are located in the bypass, the thermal lag heating chamber is located beyond the bypass and communicates separately with the lower or hot end of the cylinder for thermal lag driving of the piston during a hot rebound portion of the cycle. During the upward coasting of the piston, fluid is directed out of the hot end of the bypass in a substantially defined stream which flows through a portion of the volume of the hot cylinder end and thence into the heating chamber via a heating chamber inlet port and inlet conduit, thereby producing the required heating during coasting. The inlet port is positioned within the cylinder and very close to the lower or hot end of the bypass for capturing substantially all of the above-mentioned stream of fluid substantially independently of the choice of fluid. The lower or hot end of the free piston is concavely shaped such that it does not strike or undergo substantial frictional contact with the cylinder end-wall defining the inlet port and inlet conduit even though the lower edge of the piston moves below the port during the hot rebound.

81 Claims, 2 Drawing Figures

FIG. 1
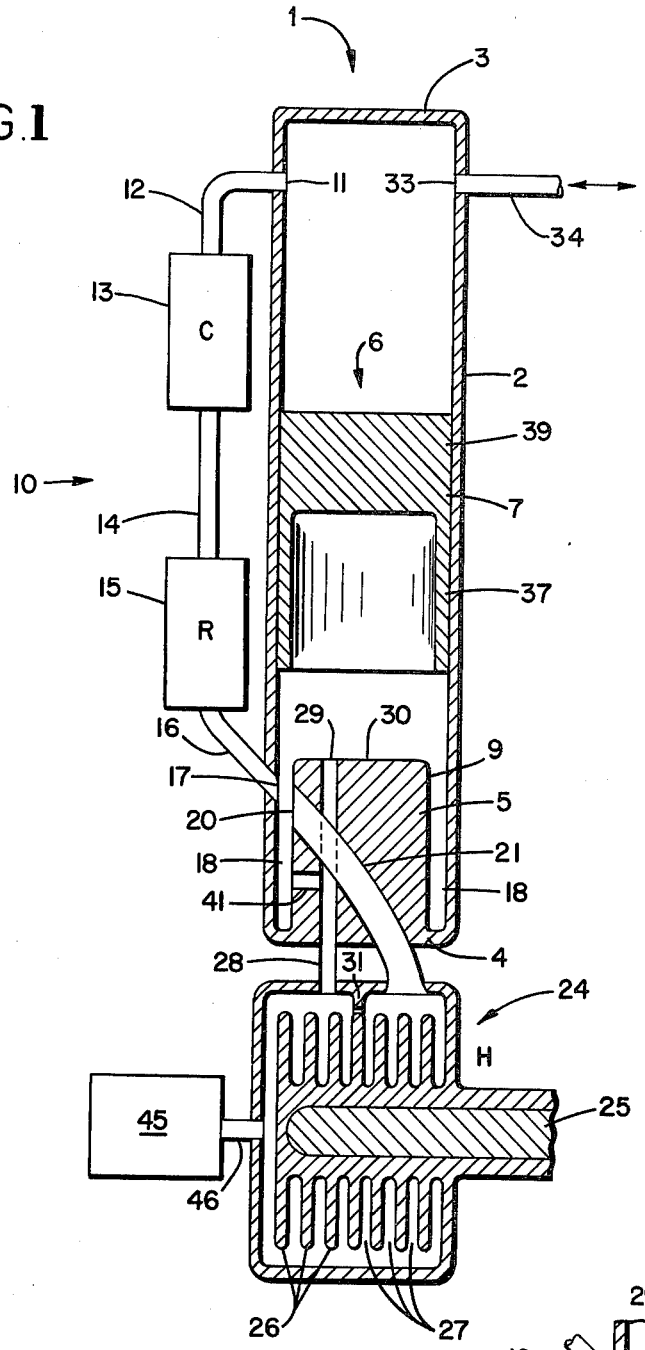
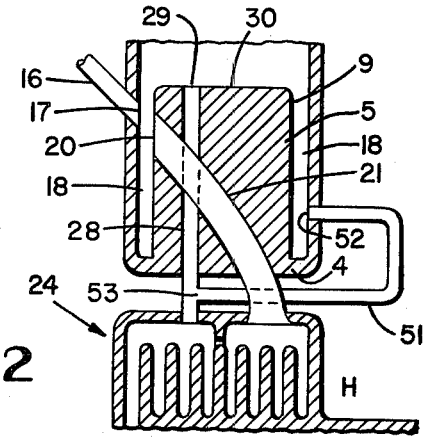
FIG. 2

THERMOCOMPRESSOR UTILIZING A FREE PISTON COASTING BETWEEN REBOUND CHAMBERS

CROSS-REFERENCE TO RELATED APPLICATIONS

This is a continuation of application Ser. No. 718,162, filed on Aug. 27, 1976, now abandoned, and which is a Continuation-In-Part Application of application Ser. No. 592,895, filed July 3, 1975, now U.S. Pat. No. 4,012,910.

FIELD OF THE INVENTION

The present invention relates generally to energy converters, more particularly to heat engines utilizing a regenerative fluid cycle, and still more particularly to a Stirling type free piston thermocompressor for pumping fluid or otherwise supplying a differential or oscillatory pressure to a load.

BACKGROUND OF THE INVENTION

K. E. Buck, W. R. Martini, Wm. T. Beale, G. M. Benson, myself and others have invented various thermally driven piston devices utilizing one or more free or semi-free pistons and alternate heating and cooling of a gas or other compressible fluid to develop a pulsating fluid pressure for pumping a fluid or otherwise driving a fluid driven load. An artificial heart, a free piston linear alternator, a fluid driven rotary motor for driving a rotary alternator, and fluid pumping for cooling purposes are several examples of uses or loads for such devices.

My inventions in this field are described primarily in my U.S. Pat. Nos. Re. 27,740, 3,767,325, 3,782,859, 3,807,904, and 3,899,888, and in my U.S. Pat. No. 4,012,910 entitled "Thermally Driven Piston Apparatus Having An Angled Cylinder Bypass Directing Fluid Into A Thermal Lag Heating Chamber Beyond The Bypass", Ser. No. 592,895, filed July 3, 1975, of which application the present application is a Continuation-In-Part. In my inventions, the free piston is driven by fluid heated in a thermal lag heating chamber, and this is one of the differences between my inventions in this field and the inventions by others; this feature facilitates a very simple thermocompressor design having a single free piston as its only moving part. In my Stirling type inventions (the second and third patents noted above and my U.S. Pat. No. 4,012,910), the device can be simplified so that the thermal lag heating chamber, which is located beyond a cylinder bypass containing a regenerator, serves not only to provide thermal lag heating for driving the free piston during piston rebound but also serves as a Stirling type heating chamber for heating the gas flowing through the bypass into the hot end of the cylinder during piston coasting.

However, since my thermal lag heating chamber is disposed beyond the bypass, it would probably be difficult with the Stirling type configurations disclosed in my patents to get substantially all of the fluid which flows through the bypass into the hot end of the cylinder to enter and flow through the thermal lag heating chamber for heating therein while the piston is coasting upwardly in the bypass region of the cylinder, the apparatus possibly therefore being operationally inefficient and perhaps having a low specific power output. In my above-mentioned U.S. Pat. No. 4,012,910, this problem was partially solved by various design features which included angling of the hot bypass conduit towards the heating chamber inlet port so that the nozzle effect of the hot bypass conduit tended to keep the fluid in a substantially defined stream which entered a heating chamber inlet port of a heating chamber inlet conduit. The fluid thence flowed into and through the heating chamber and returned to the hot end of the cylinder via a heating chamber outlet conduit. However, this fluid flow was retarded slightly by fluid drag in the heating chamber and its inlet and outlet conduits. Also, the stream of fluid flowing within the hot end of the cylinder toward the inlet port tends to enlarge and become more diffuse, depending on such factors as the inertia and diffusivity of the working fluid. Thus the limited range of the nozzle effect in combination with the fluid drag may, in my U.S. Pat. No. 4,012,910, cause a substantial amount of the fluid to miss the inlet port and not traverse the heating chamber. For example, in my U.S. Pat. No. 4,012,910 the heating chamber inlet port may be in the cylinder side-wall or in the flat end-wall and approximately on the opposite side of the cylinder axis from the hot bypass conduit, i.e., a distance from the hot bypass conduit which is approximately equal to one cylinder diameter.

In view of the above, it would be desirable to substantially decrease the distance between the hot bypass conduit and the heating chamber inlet port of the device of my U.S. Pat. No. 4,012,910 so that, for any given working fluid, a substantially greater portion of the fluid flowing out of the hot bypass conduit enters and traverses the heating chamber while the piston is coasting upwardly in the bypass region of the cylinder, thereby augmenting the pressure increase during this portion of the cycle of the thermocompressor.

SUMMARY OF THE INVENTION

The present invention is somewhat similar to the device of my U.S. Pat. No. 4,012,910, wherein a free piston oscillates between hot and cold ends of a cylinder defined at the bottom and top of the cylinder, and the cylinder can be disposed vertically to substantially eliminate mechanical friction. A cylinder bypass bypasses an axial portion of the cylinder, and contains a regenerator and a cooling chamber, the latter being above the former. A thermal lag heating chamber is located outside of the bypass and communicates with the bottom portion or hot end of the cylinder. The alternate upward and downward coasting of the piston through the bypass region forces gas downwardly and upwardly through the bypass causing alternate heating and cooling of the gas and thus a cyclical pressure variation utilizable for driving a load. Gas trapped by the piston beyond the bypass at the top and bottom of the cylinder forms gaseous compression springs which serve to reverse the piston motion. The thermal lag heating chamber heats the gas in the lower compression space so as to drive the piston upwards with enough energy to sustain the oscillation. Gas flowing downwardly through the bypass, while the piston is coasting upwardly through the bypass region of the cylinder, is directed into the hot end of the cylinder in a stream which flows into the heating chamber via a heating chamber inlet port, and the heated gas freely flows back into the hot end of the cylinder while the piston is still coasting upwardly.

However, in contrast with my U.S. Pat. No. 4,012,910, the heating chamber inlet port is located in the hot end of the cylinder at a distance from the hot bypass conduit which is equal to a small fraction of the cylinder radius. This is facilitated by making the piston cup-shaped with the open end thereof disposed downwardly, so that the piston does not substantially contact or interfere physically with the means defining the heating chamber inlet port or heating chamber inlet conduit, which are positioned within the hollow portion of the piston while the piston is rebounding at the bottom or hot end of the cylinder. Thus, the heating chamber inlet conduit is extended into the volume of the cylinder section defined by the inner surface of the piston sidewall while the piston is furthest from the cold end of the cylinder, e.g., at the bottom of its stroke. This enables the heating chamber inlet port to be located very close to the hot bypass port of the hot bypass conduit, e.g., separated only by the thin-walled portion of the piston side-wall, whereby, independently of the choice of the working fluid, substantially all of the working fluid flowing into the hot end of the cylinder via the hot bypass port while the piston is coasting away from the hot end of the cylinder flows into the heating chamber via the heating chamber inlet port and heating chamber inlet conduit for heating in the heating chamber while the piston is still coasting away from the hot end of the cylinder.

Accordingly, it is an object of the present invention to provide a new and improved thermocompressor utilizing a free oscillating piston.

Another object of the present invention is to provide a new and improved thermocompressor somewhat similar to the device of my U.S. Pat. No. 4,012,910, but wherein the heating chamber inlet port is positioned much closer to the hot bypass port, for capturing and heating more of the fluid flowing out of the hot bypass conduit and into the hot end of the cylinder during the upward coasting of the free piston.

A further object of the present invention is to provide a new and improved thermocompressor utilizing a free oscillating piston which is concave at its lower or hot face so as to avoid during the hot rebound portion of the cycle any substantial or unnecessary contact between the piston and the thermal lag heating chamber inlet conduit which conduit extends into the moving volume defined by the piston cavity formed by the concave piston face.

Still another object of the present invention is to provide a new and improved free piston thermocompressor wherein the hot end-wall of the cylinder includes a projection or nipple containing an inlet conduit of a thermal lag heating chamber.

An additional object of the present invention is to provide a new and improved thermocompressor utilizing a free oscillating piston driven by a thermal lag heating chamber, wherein the heating chamber has an inlet conduit and inlet port which are closer to the cylinder axis than is the piston sidewall, and wherein the piston sidewall acts as a sleeve surrounding the inlet port and conduit during a small portion of the oscillatory cycle, whereby the inlet port of the inlet conduit may be positioned very close to the hot bypass port of a cylinder bypass without the inlet conduit being hit by the piston, so that piston oscillation is not precluded and the gas flowing downwardly in the bypass is more thoroughly heated.

BRIEF DESCRIPTION OF THE DRAWINGS

Various other objects, features and attendant advantages of the present invention will be more fully appreciated as the same becomes better understood from the following detailed description when considered in conjunction with the accompanying drawing, wherein:

FIG. 1 is a schematic, elevational view, partly in cross-section, of a free piston Stirling-type thermocompressor employing the principles of the present invention; and FIG. 2 is a partial view of the embodiment of FIG. 1 and illustrating an alternate optional conduit means for facilitating piston rebound and thermal lag heating while preventing piston overdrive.

DETAILED DESCRIPTION OF THE ILLUSTRATED EMBODIMENTS

Referring to FIG. 1, there is illustrated a substantially closed cylinder 1 having a side-wall 2 of circular cross-section and end walls 3 and 4 at the upper and lower ends of the cylinder. The lower or hot end wall 4 includes an integral inwardly extending plug or projection or nipple 5 which may be shaped as a substantially solid cylindrical section and which protrudes a short distance axially and upwardly toward the cold end of the cylinder. Within the cylinder 1 is a free piston 6 which is cup-shaped with the open end thereof disposed downwardly so that the piston can move down to approximately the bottom of the cylinder without substantially contacting the nipple 5. Piston sidewall 7 forms a loose sliding seal with the inner surface of the cylinder sidewall 2 so as to facilitate the development of a differential pressure, in the axial direction, across piston 6. The piston oscillates between and separates the hot and cold ends of the cylinder defined by the cylinder portions below and above the piston.

Cylinder 1 has a bypass 10 which bypasses a portion, and only a portion, of the axial length of the cylinder. The bypass facilitates the coasting of the piston between rebound chambers defined within opposite ends of the cylinder, and also facilitates the alternate external heating and cooling of working fluid during the two coasting portions of the cycle. Cylinder bypass 10 includes, in seriatim, a cold bypass port 11 defined in the cylinder sidewall in the cold end of the cylinder, a cold bypass conduit 12, a cooling chamber 13, a conduit 14, a thermal regenerator 15, and an angled hot bypass conduit 16 which terminates in a hot bypass port 17 defined in the cylinder sidewall 2 in the hot end of the cylinder. Bypass 10 allows the gas or other working fluid to readily flow downwardly from the cold end of the cylinder through the bypass to the hot end of the cylinder while the piston is coasting upwardly in the bypass region of the cylinder, which upward coasting portion of the oscillatory cycle may arbitrarily be considered as the first coasting portion of the cycle of piston oscillation.

The nozzle effect of the angled hot bypass conduit 16 causes the gas exiting the hot end of the bypass via port 17 to enter the hot end of the cylinder in a substantially defined stream which is directed by the hot bypass conduit toward and into a heating chamber inlet port 20 via annular region 18 defined around nipple 5. Thus the mean flow axis of the hot bypass conduit passes approximately through the center of inlet port 20. Port 20 is defined in the cylindrical outer surface 9 of the nipple 5, and is positioned very close to hot bypass port 17. The gas stream thence follows a heating chamber inlet conduit 21 through a portion of nipple 5 and into a heating chamber 24. Thus heating chamber 24 communicates with the hot end of the cylinder via heating chamber inlet conduit 21.

The heating chamber inlet conduit 21 extends from heating chamber 24 into the nipple 5 and terminates in heating chamber inlet port 20 in the outer cylindrical surface of the nipple, whereby the inlet conduit 21 communicates with the hot cylinder end by means of the inlet port 20. Ports 17 and 20 generally would be positioned relative to each other and to the cylinder such that a plane containing the cylinder axis and passing through the center of one of the ports would also pass through the center of the other port, and in addition, the mean flow axes of conduits 16 and 21, proximate ports 17 and 20, would also generally be contained in the same plane.

Heating chamber 24, which is externally heated by means of a heating rod or pipe 25, has disc-shaped hot fins 26 forming gas passageways 27 therebetween for heating the gas stream flowing into the heating chamber 24 via the heating chamber inlet conduit 21. To facilitate the entry and heating of this gas in the heating chamber, a heating chamber outlet conduit 28 is provided so as to allow the gas in the heating chamber to flow upwardly via conduit 28 through the nipple 5 and back into the hot end of the cylinder below the piston. Thus the outlet conduit 28 terminates in port 29 in the upper, horizontal face 30 of the nipple or projection 5.

The inner surface of the outer wall of the thermal lag heating chamber 24 contains a ridge 31 shaped like a portion of a piston ring and extending part-way around the inside of the heating chamber opposite one of the fins 26 near the middle of the set of fins. Ridge 31 and its proximate heating fin restricts the gas flow path in the heating chamber so that the gas stream tends to divide and flow downwardly among the fins disposed on the right side of the heating chamber, as seen in FIG. 1, and then flow upwardly on the left side of the heating chamber and into the outlet conduit 28 which carries the heated gas back into the hot end of the cylinder while the piston is still coasting upwardly. Thus, ridge 31 produces a greater and more uniform path length for the gas flowing through the heating chamber, thereby increasing the heat transfer to the gas flowing through the heating chamber during this first coasting portion of the cycle. The heating of the gas in the regenerator and heating chamber causes a pressure increase throughout the hot and cold cylinder ends and the bypass, which pressure increase forces cool gas to flow out of the thermocompressor to a load, not shown, via a load port 33 of a load conduit 34. Load port 33 is defined in the upper cylinder sidewall portion disposed opposite the cold bypass port 11, i.e., these two ports are in the cold end of the cylinder and preferably are disposed in the same transverse plane disposed along the longitudinal extent of the cylinder.

The piston continues to coast upwardly until its sidewall 7 traverses and thereby blocks, the ports 11 and 33, whereby flow in the bypass and in the load conduit are blocked, whereupon the first coasting portion of the oscillatory cycle ends and a cold rebound portion of the cycle begins. The cold gas trapped above the piston in the cold end of the cylinder acts as a compression spring against the cold end or cold face of the piston so as to stop the upward piston motion and to cause the piston to rebound away from the cold end of the cylinder toward the hot end of the cylinder, i.e., causes the volume of the cold end of the cylinder to stop decreasing and start increasing.

As the piston rebounds downwardly, its sidewall 7 unblocks the cold bypass port 11 and load port 33, whereupon the cold rebound portion of the cycle ends and the second coasting portion of the cycle begins. As the piston coasts downwardly through the bypass region of the cylinder, heated gas is forced from the hot end of the cylinder through the regenerator and cooling chamber in the bypass and into the cold end of the cylinder. The resultant cooling of the hot gas in the regenerator and cooling chamber causes a pressure decrease throughout the hot and cold cylinder ends and the bypass, which pressure decrease draws cool gas from the load back into the cold end of the cylinder via the load conduit 34 and port 33. The regenerator, by storing heat from, and releasing heat to, the gas each cycle, augments the amplitude of the oscillatory pressure, thereby increasing the efficiency of the thermocompressor. A negative temperature gradient is established in the regenerator in an upward vertical direction. Also, the average temperature of the regenerator and the magnitude of the temperature gradient both fluctuate up and down during the cycle.

As the piston continues coasting downwardly, a cylindrically-shaped thin-walled segment 37 of the piston sidewall 7 acts as a sleeve as it passes over the nipple 5 and enters the annular region 18 defined between the nipple and the cylinder sidewall in the hot end of the cylinder. As the thin-walled segment 37 of the piston sidewall 7 traverses and blocks the hot bypass port 17, thereby again blocking gas flow in the bypass, the second coasting portion of the cycle ends and a hot rebound portion of the cycle begins. Thus the piston segment 37 passes between the hot bypass port 17 and the heating chamber inlet port 20 during the hot rebound portion of the cycle. The hot rebound is caused by the piston trapping and compressing gas in the hot end of the cylinder between it and cylinder end wall 4, and in the heating chamber 24, which gas forms a hot gaseous rebound chamber. The hot rebound chamber includes the heating chamber 24, its inlet and outlet conduits 21 and 28, the cylinder region above the nipple 5 and below the thick-walled or solid or central portion 39 of the piston, the portion of the annular region 18 not occupied by piston segment 37, and an optional short conduit 41 connecting the annular region 18 with the heating chamber outlet conduit 28 within the nipple 5.

The short circuit 41 may be useful for trapping gas in the bottom of the annular region so as to prevent the piston from overdriving and hitting the nipple or the bottom of the cylinder, i.e., the hot end wall 4. If the conduit 41 is to be used in this way, there must be some degree of sealing between the inside surface of the thin-walled segment 37 of the piston and the outer surface 9 of the nipple, at least in the lower portion of the annular region 18, but this seal need not be nearly as good as the piston cylinder seal since the lower portion of the annular region below conduit 41 need only act as a leaky or lossy small rebound chamber acting as a stiff and lossy compression spring to damp out excessive motion of the piston below the conduit 41. Thus, a high degree of precision is not required on the diameters, circularity, and concentricity of the outer surface 9 of the nipple and the inner surface of the thin-walled segment 37 of the piston, either on an absolute basis or with respect to each other or with respect to the inner surface of the cylinder sidewall. Still further, the sliding seal between the nipple and the piston segment 37 might not even be necessary, since the trapping of gas in the hot rebound chamber may itself be sufficient to avoid piston overdrive under conditions of variable load on the thermocompressor.

During the early part of the hot rebound portion of the cycle, the piston compresses and forces relatively cool gas from the hot end of the cylinder into the heating chamber 24 via conduits 28 and 41 and/or 21. The heating chamber is designed in accordance with thermal lag principles to substantially continuously heat the gas throughout the hot rebound portion of the cycle, thereby augmenting the gaseous spring effect so as to drive the piston toward the cold cylinder end with a speed and kinetic energy sufficient to sustain the piston oscillation. Thus the heating chamber, plus perhaps a few other surfaces, such as the surfaces of the nipple and the conduits therein, supply sufficient thermal energy to the gas during the hot rebound so that the kinetic energy of the piston at the end of the hot rebound portion of the cycle is sufficiently greater than the kinetic energy of the piston at the beginning of the hot rebound portion of the cycle so as to sustain the piston oscillation in spite of small frictional, thermal, vibrational and pumping losses which would otherwise gradually cause the piston motion to stop.

One of the reasons why the gas forced into the heating chamber during the hot rebound is relatively cool, i.e., cooler than the heating chamber fins 26, is that gas forced downwardly in the bypass during the first coasting portion of the cycle is never completely and thoroughly heated in the heating chamber. Another reason is that there is a small amount of unavoidable cooling of the gas in the hot end of the cylinder by the internal piston and cylinder wall surfaces; however, because of the low surface area-to-volume ratio in the hot cylinder end, the amount of such cooling is small. Still another reason for the gas being relatively cool is that, under load, there is a drop in pressure in the thermocompressor due to the cooling of the gas flowing upwardly in the bypass as the piston is coasting downwardly. This drop in pressure during the second coasting portion of the cycle causes a substantially adiabatic drop in temperature of most of the gas in the hot end of the cylinder, thus helping to make the gas relatively cool just prior to the hot rebound and thereby facilitating and augmenting the thermal lag driving of the piston in the hot rebound portion of the cycle by thermal lag heating chamber 24.

Thermal lag driving of the free piston is discussed in my above-mentioned patents, especially my U.S. Pat. No. 3,807,904. However, in the present invention, as in some of my previously invented Stirling type configurations, the heating chamber 24 has a dual role. During the first coasting portion of the cycle, it functions approximately as an ordinary Stirling-type heating chamber, while during the hot rebound portion of the cycle it functions as a thermal lag heating chamber. Therefore, it is to be expected that the optimum design will be a compromise between the optimum designs for the two types of chambers under the particular conditions of operation.

The rebounding piston 6 is driven upwardly by the heated gas expanding within the heating chamber and expanding out of the heating chamber via conduits 28 and 41 and/or 21 until the piston sidewall unblocks the hot bypass port 17, whereupon the hot rebound portion of the cycle ends and the first coasting portion of the next cycle of piston oscillation begins, causing the gas to again flow downwardly through the bypass for heating in the regenerator and further heating in the heating chamber.

The device may be started by a single pressure pulse of the working gas applied below the piston so that the fluid pulse acts against the lower or hot face of the piston in order to drive the piston upwardly. Starter 45, which is connected via conduit 46 to the heating chamber 24, is a source of such pressurized gas pulses. The gas for the starting pulse may be drawn from the region above the piston. A sufficient suction pulse, applied above the piston, will also serve to start the piston oscillation.

Hot bypass conduit 16 is angled toward the hot end of the cylinder, whereby, as in my U.S. Pat. No. 4,012,910, the substantially defined stream of fluid exiting port 17 has a velocity component directed parallel to the cylinder axis in the direction extending from the cold end of the cylinder to the hot end of the cylinder, i.e., downwardly as seen in FIG. 1. Thus, if the angling is fairly sharp with respect to a perpendicular to the cylinder axis, the distance between the centers of the hot bypass port 17 and the heating chamber inlet port 20 can be approximately 2–3 times the wall thickness of the thin-walled segment 37 of the piston sidewall, which distance is a small fraction of the radius of the cylinder, and is much less than the distance disclosed in my U.S. Pat. No. 4,012,910. If the conduit 16 is not angled very sharply, the distance between ports 17 and 20 can be approximately 1–2 times the thickness of piston segment 37. The angling of the bypass is optional, however, and if conduit 16 is not angled at all, i.e., if its mean flow axis is perpendicular to the cylinder axis, the distance between ports 17 and 20 may be approximately equal to the wall thickness of piston segment 37. Therefore, since the wall thickness of the piston segment 37 can easily be less than one tenth of the radius of cylinder 1, it may be seen that the distance between ports 17 and 20 may easily be as small as approximately one tenth, or an order of magnitude smaller than, the cylinder radius, whereby, for most any working fluid, substantially all of the fluid exiting port 17 during the first coasting portion of the cycle flows, in seriatim, through the annular region 18, into heating chamber inlet port 20, through heating chamber inlet conduit 21, and into and through heating chamber 24 for heating in the heating chamber during this first coasting portion of the cycle. Most of this fluid flows back into the hot end of the cylinder via conduit 28 during this first coasting portion of the cycle. This flow of fluid into and out of the heating chamber is facilitated by properly positioning and aligning conduits 16 and 21, and ports 17 and 20, including aligning the mean flow axis of a portion of conduit 21 near port 20 with the mean flow axis of conduit 16.

Although the cylinder axis is disposed vertically in FIG. 1, with the heating chamber near the bottom, which orientation minimizes piston-cylinder friction and facilitates easy starting of the device, it should be understood that the device can be started and operated in any orientation.

Various types of fluid-driven loads can be driven by the thermo-compressor of the present invention, and one example is a free piston linear alternator driven by the oscillatory pressure available at conduit 34. Another example is a fluid-driven rotary motor which drives a conventional rotary alternator. Two check valves and a high and a low pressure storage tank may be connected to conduit 34 so as to produce a steady differential pressure for driving the rotary motor. The thermocompressor may be powered by solar energy, a fossil fuel flame, waste heat, burning garbage, or most any other heat source of sufficient temperature. The alternator can supply A.C. or D.C. electrical power to a home, a vehicle, a motor driven water pump in a remote area, or various other types of loads.

The thickness of the annular region 18 is equal to the difference in radii of the inside surface of the cylinder sidewall and the cylindrical outer surface 9 of the nipple 5. As mentioned above, this thickness need only be sufficiently greater than the wall thickness of thin-walled piston segment 37 so as to provide a clearance such that the segment 37 does not substantially contact the nipple or otherwise jam or suffer undue friction in annular region 18. Thus, the thickness of the annular region need only be a small fraction of the radius of the cylinder, whereby the thinness of this annular region facilitates passage of the fluid stream from port 17 into port 20 with minimal loss of fluid from the stream. To further facilitate this fluid passage, port 20 is slightly larger than port 17, and conduit 21 is slightly larger in diameter than conduit 16, whereby the fluid stream from the hot bypass conduit may diffuse slightly in its passage through the annular region 18 and still enter the heating chamber inlet port and inlet conduit for passage into the heating chamber for heating therein during the first coasting portion of the cycle.

The working fluid can be a gas, such as hydrogen or helium, or other compressible fluid. For example, it might be feasible to use a water-air mixture if, among other factors, the water can be sufficiently aerosolized. Because of various features of the present invention, including especially the relatively short distance between the hot bypass port and the heating chamber inlet port, the statements made above regarding the substantially complete passage of fluid from the bypass into and through the heating chamber during the first coasting portion of the cycle are believed to be valid substantially independently of the choice of the working fluid.

In a very broad sense, the thermocompressor or energy converter of the present invention may be considered as a Stirling type device inasmuch as it alternately and regeneratively heats and cools a working fluid to develop a cyclical pressure variation for doing work on a load. However, the actual thermodynamic cycle depends on the particular design and the operating conditions, including the nature of the working fluid and the load, and is generally expected to differ substantially from the true Stirling cycle.

Since the heating chamber inlet and outlet conduits separately extend into the hot end of the cylinder, the gas flowing from the heating chamber into the hot end of the cylinder via the outlet conduit during the first coasting portion of the cycle does not interfere with the fluid stream directed into the heating chamber from the hot end of the cylinder bypass. This would still be true if most of the material of the nipple were removed so that all that remained of the nipple were two thin-walled tubes serving respectively as heating chamber inlet and outlet conduit. However, such a change in structure would tend to increase the dead volume in the hot end of the cylinder, e.g., the gas volume unswept by the piston and not serving any useful purpose, thereby lowering the engine efficiency and increasing its required size for a given load. Such a change in structure might be possible, but it would be more difficult to properly configure the piston so as to sweep the hot end of the cylinder and force a high percentage of the gas therein into the heating chamber during the hot rebound cycle portion. The piston might then have to be indexed so that it maintains a fixed rotational or azimutha' position with respect to the cylinder so that a specially shaped cavity in the bottom face of the piston would always be positioned to slip over the two conduits during the hot rebound portion of the cycle, i.e., while the volume of the hot end of the cylinder has values in a minimum range. Thus, while the nipple shaped as illustrated in FIG. 1 and described above is a preferred feature of the invention, other shapes are possible but may lead to greater complexity and difficulties of operation and fabrication.

Since the heating chamber inlet port as illustrated is so close to the hot bypass port, there are many possible positions and orientations of the heating chamber outlet conduit 28 and outlet port 29 which would not cause substantial interference between the heated fluid returning to the cylinder and the directed fluid stream exiting the hot bypass port. However, if, as illustrated, the annular region around the nipple is approximately the same thickness as that of the thin-walled piston segment, it is necessary for the cylinder region between the lower face of the piston and the upper face 30 of the nipple to communicate with the heating chamber during the hot rebound cycle portion so that the piston can drive the gas trapped in this cylinder region into the heating chamber for subsequent heating and driving of the piston. Under these circumstances, it is desirable for the heating chamber outlet conduit to extend upwardly through the nipple and terminate in port 29 in the upper face 30 of the nipple which faces the central portion of the free piston rather than the thin-walled piston segment. Under these circumstances, it is also preferable for the portion of the annular region 18 below the piston segment 37 to communicate with the heating chamber during the hot rebound cycle portion so that the piston can drive this gas into the heating chamber during the hot rebound cycle portion, and this is a function of the short conduit 41.

Apparently, one of the advantages of my general approach to thermocompressors is that, because the heating chamber 24 is positioned beyond the bypass, the gas is heated in the heating chamber primarily while the gas is flowing via the bypass into the hot end of the cylinder rather than while the gas is flowing via the bypass back into the cold end of the cylinder, in contrast with the typical Stirling engine and the approach taken by Beale. Another feature of my approach which may be an advantage in various applications is that the free piston is self-oscillating, wherein the piston oscillation continues under an overload condition as well as under no load, and requires no feedback from a load, e.g., it requires no inertial working member, such as a heavy working piston. For example, the thermocompressor illustrated in FIG. 1 could continue running whether the load conduit were completely blocked or were completely open to the atmosphere. As mentioned above, the device as illustrated could charge a high and a low pressure storage tank by utilizing only two check valves and appropriate conduits, without requiring a working piston. The differential pressure from the tanks can then be used to drive a rotary machine, such as a rotary motor driving a rotary alternator. Of course, the foregoing are only two of the many factors to be considered in determining which energy conversion approach is best in a given application.

As I have mentioned in previous patent applications, the means for reversing the piston at the cold end of the cylinder can take other forms, e.g., a smaller diameter gaseous rebound chamber (by using a short rod on the cold piston face or on the cold cylinder end wall which compresses gas trapped in a matching cylindrical cavity in the opposite member), a mechanical spring, a magnetic field which repels the piston, or merely gravity, in which latter case the cylinder would probably be made taller and the bypass longer.

It should also be understood that the terms "hot", "warm", "cool" and "cold" are relative only. For example, the "cold" end of the cylinder might be considerably hot during operation, but the hot end of the cylinder will then be still hotter.

In addition, it is also to be noted that if the thermocompressor is connected to a load which cools the fluid, or if a source of cool fluid is being pumped by the thermocompressor, the cooling chamber 13 in the bypass is not necessary.

Referring now to FIG. 2, there is illustrated an alternative optional means of facilitating the hot rebound of the free piston while preventing the piston from striking the hot end wall, comprising an alternate optional conduit 51 which may be used instead of the optional short conduit 41 to trap gas in the bottom portion of the annular region 18. Optional conduit 51 communicates with the annular region 18 by means of a port 52 defined in the cylinder sidewall at a location which is a short distance above the bottom of the annular region. Conduit 51 communicates at its other end with heating chamber outlet conduit 28 via a port 53 defined in the wall of the outlet conduit 28 in a portion of the outlet conduit between hot end wall 4 and heating chamber 24. Thus the heating chamber communicates with the annular region 18 of the hot end of the cylinder by means of conduits 28 and 51. Therefore the heating chamber outlet conduit 28 communicates with the hot cylinder end by means of ports 29 and 52. Piston segment 37 traverses and blocks the port 52 to trap gas in the bottom of the annular region so as to form a small rebound chamber acting as a stiff gaseous compression spring to prevent piston overdrive. Conduit 51 thus serves the same purpose as conduit 41, but an advantage of conduit 51 over conduit 41 is that the outer surface of piston segment 37 blocks gas flow in conduit 51, while it is the inner surface of the piston segment 37 which blocks flow in the alternative short conduit 41. The sliding seal between the piston and cylinder sidewalls is normally a much better seal than between the piston segment 37 and the outer surface 9 of the nipple. Also, if the port to be blocked by the segment 37 is in the cylinder sidewall rather than in the nipple, the two parallel leakage paths on the inside and outside of segment 37 have better relative lengths or better balance between them and lower total leakage of the trapped gas, e.g., the poorer sealing surface has the longer sealing length. Therefore, to reduce gas leakage and associated piston energy loss, it is better that such a conduit be blocked by the outer surface of piston segment 37 than by its inner surface. The use of conduit 51 rather than conduit 41 would therefore further ease the required circularity of the nipple surface 9 and the inner surface of the piston segment 37, the required accuracy of the diameters of these two surfaces, and their required concentricity with respect to the piston-cylinder interface. It should be understood, however, that, as mentioned earlier, the rebound chamber comprising the heating chamber 24 and the hot end of the cylinder may be sufficient to prevent piston overdrive, in which case neither conduit 41 nor conduit 51 would be needed, and gas displaced in the annular region 18 by the piston segment 37 could merely flow freely upward in the space between the outer surface 9 of the nipple and the inside surface of the piston segment 37, which space could be made sufficiently wide to facilitate this free upward gas flow around the nipple. Thus the device would have one or neither of conduits 41 and 51, but probably not both.

The short conduit 41 can be replaced by one or more vertical grooves (not shown) in the outer surface 9 of the nipple and extending from nipple face 30 downwardly to a short distance above the bottom of the annular region 18. The grooves would allow gas displaced by piston segment 37 to flow upwardly via the grooves into the cylinder region just above nipple face 30. If it is determined that the gaseous compression spring in the bottom of the annular region is not needed, the grooves may extend all the way down to the bottom of the annular region. The grooves would not pass through heating chamber inlet port 20, and would allow the inlet port to be disposed very close to the path of the inner surface of the piston segment 37, and thus very close to the hot bypass port 17, for more thorough capturing of the substantially defined stream of gas exiting the hot end of the bypass during upward coasting of the piston.

The use of the grooves, or of conduit 41 or 51, may result in a slight sideways or transverse force on the piston toward the cylinder sidewall or nipple by the pressure of fluid in the grooves or in the conduit 41 or 51, in combination with the pressure of fluid leaking assymmetrically out of the gaseous compression spring at the bottom of the annular region. It this slight transverse force causes a problem, such as piston slowdown or greater piston-cylinder friction and wear, the force can be cancelled by using a pair of like grooves or a pair of like conduits on opposite sides of the cylinder axis. Similarly, a pair of hot bypass conduits and hot bypass ports can be utilized on opposite sides of the cylinder if such a problem is generated by the presence of the hot bypass port. However, I have built a thermally powered model which demonstrates piston coasting and thermal lag driving of the free piston. The cylinder sidewall has a port which is periodically traversed and blocked by the piston, causing a slight transverse force such as discussed above, but I have noticed no increase in piston-cylinder friction nor any related degradation of the piston oscillation.

Port 52 of conduit 51 is located on the side of the cylinder opposite the hot bypass port 17. This increases the length of the leakage path between ports 52 and 17, thereby reducing the leakage between these two ports during piston overdrive, i.e., the segment of the hot rebound portion of the cycle while port 52 is blocked by the piston segment 37.

Although conduits 41 and 51 as illustrated in FIGS. 1 and 2 are in the same plane as the conduits 16 and 21, it is not necessary that conduit 41 or 51 or the above-mentioned groove be in the same plane as conduits 16 and 21.

Obviously, many modifications and variations of the present invention are possible in light of the above teachings. It is therefore to be understood that the present invention may be practiced, within the scope of the appended claims, otherwise than as specifically described herein.

What is claimed as new and desired to be secured by Letters Patent of the United States is:

1. A thermocompressor comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston moves in alternate directions between said cylinder ends;

means for cooling the fluid flowing into the cold cylinder end and for heating the fluid flowing into the hot cylinder end thereby producing a cyclical fluid pressure variation utilizable for driving a load;

said heating means including a heating chamber disposed outside of the bypass and communicating with the hot end of the cylinder via a heating chamber inlet conduit, said inlet conduit communicating with the hot end of the cylinder via a heating chamber inlet port defined in the hot end of the cylinder;

said bypass including, in seriatim, a cold bypass port defined in said cold end of the cylinder, a hot bypass conduit, and a hot bypass port defined in the sidewall of the cylinder in said hot end of the cylinder, whereby the fluid exiting the hot end of the bypass via said hot bypass port flows into the hot end of the cylinder in a substantially defined stream during a first portion of the ocillatory cycle while the piston is moving in the bypass region of the cylinder toward the cold end of the cylinder;

means for positioning and aligning said hot bypass conduit and said heating chamber inlet port with respect to each other and with respect to the hot end of the cylinder so as to augment passage of said fluid in said stream into said heating chamber via said inlet port and said inlet conduit for heating fluid in the heating chamber during said first portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end with a greater piston kinetic energy at the end of the hot rebound cycle portion than the kinetic energy of the piston at the beginning of the hot rebound cycle portion; and means for reversing the piston motion at the cold cylinder end, said positioning and aligning means including means for positioning the heating chamber inlet port within the hot end of the cylinder at a location such that its distance from the hot bypass port is a small fraction of the diameter of the cylinder, whereby said passage of fluid in said stream into said heating chamber is further augmented, thereby augmenting said heating of fluid during said first portion of the cycle.

2. A thermocompressor as set forth in claim 1 wherein:

said distance between said heating chamber inlet port and said hot bypass port is less than one-tenth of the radius of the cylinder.

3. A thermocompressor comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston moves in alternate directions between said cylinder ends;

means including a regenerator in the bypass for cooling the fluid flowing into the cold cylinder end and for heating the fluid flowing into the hot cylinder end thereby producing a cyclical fluid pressure variation utilizable for driving a load;

said heating means including a heating chamber disposed beyond the bypass and communicating with the hot end of the cylinder via a heating chamber inlet port defined in the hot end of the cylinder;

said bypass including, in seriatim, said regenerator, a hot bypass conduit, and a hot bypass port defined in the sidewall of the cylinder in said hot end of the cylinder, whereby the fluid exiting the hot end of the bypass via said hot bypass port flows into the hot end of the cylinder in a substantially defined stream during a first portion of the oscillatory cycle while the piston is moving in the bypass region of the cylinder toward the cold end of the cylinder;

means for positioning and aligning said hot bypass conduit and said heating chamber inlet port with respect to each other and with respect to the hot end of the cylinder so as to facilitate passage of said fluid in said stream into said heating chamber via said inlet port for heating fluid in the heating chamber during said first portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end; and means for reversing the piston motion at the cold cylinder end;

said positioning and aligning means including means for positioning the heating chamber inlet port within the hot end of the cylinder at a location such that its distance from the hot bypass port is a small fraction of the radius of the cylinder, whereby said passage of fluid in said stream into said heating chamber is further facilitated, thereby augmenting said heating of fluid during said first portion of the cycle.

4. A thermocompressor as set forth in claim 3 wherein:

said distance between said hot bypass port and said heating chamber inlet port is approximately one-tenth of the radius of the cylinder.

5. A thermocompressor as set forth in claim 3 wherein:

said distance is less than one-tenth of the radius of the cylinder.

6. A thermocompressor comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston coasts in alternate directions between said cylinder ends;

means including a regenerator in the bypass for cooling the fluid flowing into the cold cylinder end and for heating the fluid flowing into the hot cylinder end thereby producing a cyclical fluid pressure variation utilizable for driving a load;

said heating means including a heating chamber disposed beyond the bypass and communicating with the hot end of the cylinder via a heating chamber inlet port defined in the hot end of the cylinder;

said bypass including, in seriatim, said regenerator, a hot bypass conduit, and a hot bypass port defined in the sidewall of the cylinder in said hot end of the cylinder, whereby the fluid exiting the hot end of the bypass via said hot bypass port flows into the hot end of the cylinder in a substantially defined stream during a first coasting portion of the oscillatory cycle while the piston is coasting in the bypass region of the cylinder toward the cold end of the cylinder;

means for positioning and aligning said hot bypass conduit and said heating chamber inlet port with respect to each other and with respect to the hot end of the cylinder so as to facilitate passage of said fluid in said stream into said heating chamber via said inlet port for heating fluid in the heating chamber during said first coasting portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end; and means for reversing the piston motion at the cold cylinder end;

said positioning and aligning means including means for positioning the heating chamber inlet port within the hot end of the cylinder at a location such that its distance from the hot bypass port is a small fraction of the radius of the cylinder, whereby said passage of fluid in said stream into said heating chamber is further facilitated, thereby augmenting said heating of fluid during said first coasting portion of the cycle.

7. A thermocompressor as set forth in claim 6 wherein:

the piston at its hot end has a hot face facing the hot end of the cylinder, said hot face being concavely shaped to facilitate said blocking of the hot bypass port without substantially contacting said heating chamber inlet port during normal operation of the thermocompressor.

8. A thermocompressor as set forth in claim 6 wherein:

the piston is substantially cup-shaped with the open end of the cup facing the hot end of the cylinder.

9. A thermocompressor as set forth in claim 6 wherein:

said cylinder has a hot end-wall at the hot end of the cylinder, said hot end-wall including a nipple protruding in a direction toward the piston, said heating chamber inlet port being defined in an outer surface of said nipple at a location proximate said hot bypass port.

10. A thermocompressor as set forth in claim 6 wherein:

said heating chamber inlet port and said hot bypass conduit are disposed and oriented such that said hot bypass conduit has a mean flow axis which passes approximately through the center of said inlet port.

11. A thermocompressor as set forth in claim 6 wherein:

said cooling means includes a cooling chamber disposed in said bypass between said regenerator and said cold end of said cylinder.

12. A thermocompressor as set forth in claim 6 wherein:

said bypass conduit is angled, with respect to a plane perpendicular to the cylinder axis, so that the fluid flowing from the hot end of the bypass into the cylinder via the hot bypass port has a substantial velocity component parallel to the axis of the cylinder and extending in a direction from the cold cylinder end to the hot cylinder end.

13. A thermocompressor as set forth in claim 6 wherein:

said heating chamber is configured so as to substantially continuously heat fluid within said heating chamber during said hot rebound cycle portion, said continuous heating resulting in a greater piston kinetic energy at the end of the hot rebound cycle portion than the kinetic energy of the piston at the beginning of the hot rebound cycle portion, said continuous heating providing sufficient heat energy to sustain the piston oscillation.

14. A thermocompressor as set forth in claim 6 wherein:

said compressible fluid may be a gas or a liquid-gas mixture and, substantially independently of the choice of fluid, said positioning and aligning means facilitates, during said first coasting portion of the cycle, heating by said heating chamber of substantially all of the fluid flowing out of the hot bypass port into the hot end of the cylinder.

15. A thermocompressor as set forth in claim 6 wherein:

said distance between said hot bypass port and said heating chamber inlet port is approximately one-tenth of the radius of the cylinder.

16. A thermocompressor as set forth in claim 6 wherein:

said distance is less than one-tenth of the radius of the cylinder.

17. A thermocompressor as set forth in claim 6 wherein:

the piston at its hot end has a thin-walled piston segment which passes between said hot bypass port and said heating chamber inlet port and accomplishes said blocking of said hot bypass port during said hot rebound cycle portion.

18. A thermocompressor as set forth in claim 17 wherein:

said distance between said hot bypass port and said heating chamber inlet port is approximately equal to the wall thickness of said piston segment.

19. A thermocompressor as set forth in claim 17 wherein:

said distance between said hot bypass port and said heating chamber inlet port is approximately 1–2 times the wall thickness of said piston segment.

20. A thermocompressor as set forth in claim 6 wherein:

the cylinder has a hot end-wall at the hot end of the cylinder, said hot end-wall including a nipple protruding in a direction toward the piston, said heating chamber inlet port being defined in a substantially cylindrically shaped outer surface of said nipple at a location proximate said hot bypass port, said piston at its hot end having a substantially cylindrically shaped thin-walled segment which passes as a sleeve over said outer nipple surface during said hot rebound portion of the cycle.

21. A thermocompressor as set forth in claim 20 further comprising:

a groove in said outer surface of said nipple.

22. A thermocompressor as set forth in claim 6 wherein:

said heating chamber further communicates with the hot end of the cylinder via a heating chamber outlet port defined in the hot end of the cylinder.

23. A thermocompressor as set forth in claim 22 wherein:

said outlet port is defined in a surface of said nipple approximately facing a central portion of said piston.

24. A thermocompressor as set forth in claim 22 wherein:

said outlet port is positioned and said piston is shaped such that said further communication is maintained during at least a substantial portion of said hot rebound cycle portion.

25. A thermocompressor as set forth in claim 6 wherein:

the piston at its hot end has a hot face facing the hot end of the cylinder, said hot face being concavely shaped so as to form a piston cavity at the piston hot end, and said heating chamber inlet port being located such that, during said hot rebound cycle portion, the moving volume defined by said piston cavity moves sufficiently far in a direction from said cold cylinder end toward said hot cylinder end so as to contain said heating chamber inlet port within said moving volume.

26. A thermocompressor as set forth in claim 25 wherein:

said heating chamber further communicates with the hot end of the cylinder via a heating chamber outlet port, wherein said moving volume also contains said outlet port during a fraction of the oscillatory cycle.

27. A thermocompressor comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston coasts in alternate directions between said cylinder ends;

means for cooling the fluid flowing into the cold cylinder end and for heating the fluid flowing into the hot cylinder end thereby producing a cyclical fluid pressure variation utilizable for driving a load;

said heating means including a heating chamber disposed outside of the bypass and communicating with the hot end of the cylinder via a heating chamber inlet conduit, said inlet conduit communicating with the hot end of the cylinder via a heating chamber inlet port in the hot end of the cylinder;

said bypass including, in seriatim, a cold bypass port in said cold end of the cylinder, a hot bypass conduit, and a hot bypass port in the sidewall of the cylinder in said hot end of the cylinder, whereby the fluid exiting the hot end of the bypass via said hot bypass port flows into the hot end of the cylinder in a substantially defined stream during a first coasting portion of the oscillatory cycle while the piston is coasting in the bypass region of the cylinder toward the cold end of the cylinder;

means for positioning and aligning said hot bypass conduit and said heating chamber inlet port with respect to each other and with respect to the hot end of the cylinder so as to facilitate passage of said fluid in said stream into said heating chamber via said inlet port and said inlet conduit for heating fluid in the heating chamber during said first coasting portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end with a greater piston kinetic energy at the end of the hot rebound cycle portion than the kinetic energy of the piston at the beginning of the hot rebound cycle portion; and means for reversing the piston motion at the cold cylinder end, said positioning and aligning means including means for positioning the heating chamber inlet port within the hot end of the cylinder at a location such that its distance from the hot bypass port is a small fraction of the diameter of the cylinder, whereby said passage of fluid in said stream into said heating chamber is further facilitated, thereby augmenting said heating of fluid during said first coasting portion of the cycle.

28. A thermocompressor as in claim 27 wherein said heating chamber inlet port is slightly larger than said hot bypass port.

29. A thermocompressor as in claim 27 wherein said distance between said hot bypass port and said heating chamber inlet port is a small fraction of the radius of the cylinder.

30. A thermocompressor as in claim 27 wherein said distance between said hot bypass port and said heating chamber inlet port is approximately one order of magnitude smaller than the diameter of the cylinder.

31. A thermocompressor as in claim 27 wherein said bypass conduit is angled with respect to a perpendicular to the cylinder axis so that the fluid flowing from the hot end of the bypass into the cylinder via the hot bypass port has a substantial velocity component parallel to the axis of the cylinder and extending in a direction from the cold cylinder end to the hot cylinder end.

32. A thermocompressor as in claim 27 wherein said compressible fluid may be a gas or a liquid-gas mixture and, substantially independently of the choice of fluid, said positioning and aligning means facilitates, during said first coasting portion of the cycle, heating by said heating chamber of most of the fluid flowing out of the hot bypass port into the hot end of the cylinder.

33. A thermocompressor as in claim 27 wherein said compressible fluid may be a gas or a liquid-gas mixture and, substantially independently of the choice of fluid, said positioning and aligning means facilitates, during said first coasting portion of the cycle, heating by said heating chamber of substantially all of the fluid flowing out of the hot bypass port into the hot end of the cylinder.

34. A thermocompressor as in claim 27, wherein said bypass contains a thermal regenerator interposed between said cold bypass port and said hot bypass conduit, wherein said heating means and said cooling means each include said regenerator, said regenerator improving the efficiency of the thermocompressor.

35. A thermocompressor as in claim 27 wherein said cooling means comprises means for connecting the cold end of the cylinder to a cooled load.

36. A thermocompressor as in claim 27, wherein said cooling means comprises a cooling chamber disposed in said bypass proximate the cold end of said cylinder.

37. A thermocompressor as in claim 27 wherein said means for reversing the piston motion at the cold cylinder end includes a gaseous spring action of fluid compressed by the piston in the cold end of the cylinder after said first coasting portion of the cycle.

38. A thermocompressor as in claim 27 wherein said distance between said hot bypass port and said heating chamber inlet port is approximately one order of magnitude smaller than the radius of the cylinder.

39. A thermocompressor as in claim 27 wherein the piston at its hot end has a hot face facing the hot end of the cylinder, said hot face being concavely shaped to form a piston cavity at the piston hot end and said heating chamber inlet port being located such that, during said hot rebound cycle portion, the moving volume defined by said piston cavity moves sufficiently far in a direction from said cold cylinder end toward said hot cylinder end so as to contain said heating chamber inlet port within said moving volume.

40. A thermocompressor as in claim 27 wherein said heating chamber is designed to substantially continuously heat fluid within said heating chamber during said hot rebound cycle portion, said continuous heating providing sufficient heat energy to sustain the piston oscillation.

41. A thermocompressor as set forth in claim 27 wherein: said distance between said hot bypass port and said heating chamber inlet port is less than one-tenth of the radius of the cylinder.

42. A thermocompressor as set forth in claim 27 wherein:

the piston at its hot end has a thin-walled piston segment which passes between said hot bypass port and said heating chamber inlet port and accomplishes said blocking of said hot bypass port during said hot rebound cycle portion.

43. A thermocompressor as set forth in claim 42, wherein:

said distance between said hot bypass port and said heating chamber inlet port is less than one-tenth of the radius of the cylinder.

44. A thermocompressor as in claim 27 wherein said heating means further includes a heating chamber outlet conduit communicating with said hot end of said cylinder.

45. A thermocompressor as in claim 44 wherein said heating chamber outlet conduit communicates with said hot end of said cylinder via two ports in said hot end of said cylinder.

46. A thermocompressor as in claim 27, wherein said cold bypass port is disposed in the sidewall of the cylinder in the cold end of the cylinder.

47. A thermocompressor as in claim 46, further including a load port in the cylinder sidewall, said load port being disposed at approximately the same longitudinal position along the length of the cylinder as is said cold bypass port.

48. A thermocompressor as in claim 27 wherein said heating chamber further communicates with said hot end of said cylinder via a heating chamber outlet port means.

49. A thermocompressor as in claim 48 wherein said outlet port means includes a port in said cylinder sidewall in said hot end of said cylinder.

50. A thermocompressor as in claim 27 wherein the piston at its hot end has a hot face facing the hot end of the cylinder, said hot face being concavely shaped so that it does not substantially contact said heating chamber inlet port or inlet conduit during normal operation of the thermocompressor.

51. A thermocompressor as in claim 50 wherein the piston is substantially cup-shaped with the open end of the cup facing the hot end of the cylinder.

52. A thermocompressor as in claim 50 wherein the hot end of the piston has a thin-walled segment which, during said hot rebound portion of the cycle, passes between said hot bypass port and said heating chamber inlet port.

53. A thermocompressor as in claim 52 wherein said distance between said hot bypass port and said heating chamber inlet port is approximately equal to the wall thickness of said piston segment.

54. A thermocompressor as in claim 52 wherein said distance between said hot bypass port and said heating chamber inlet port is approximately 1–2 times the wall thickness of said piston segment.

55. A thermocompressor as in claim 52 wherein said distance between said hot bypass port and said heating chamber inlet port is approximately 2–3 times the wall thickness of said piston segment.

56. A thermocompressor as in claim 52 wherein said cylinder has a hot end-wall at the hot end of the cylinder, said hot end-wall including a nipple protruding in a direction toward the hot face of the piston, said heating chamber inlet conduit extending into said nipple such that said heating chamber inlet port is disposed in an outer surface of said nipple at a location proximate said hot bypass port.

57. A thermocompressor as in claim 56 wherein said thin-walled piston segment is substantially cylindrically-shaped and said outer surface of said nipple is substantially cylindrically-shaped, said piston segment passing as a sleeve over said outer nipple surface during said hot rebound portion of the cycle.

58. A thermocompressor as set forth in claim 57 wherein:

the wall thickness of said piston segment is a very small fraction of the radius of the cylinder.

59. A thermocompressor as set forth in claim 58 wherein:

said wall thickness is less than one-tenth of the radius of the cylinder.

60. A thermocompressor as in claim 57 wherein the wall thickness of said piston segment is approximately equal to the thickness of the annular region between said outer nipple surface and the inner surface of the cylinder sidewall.

61. A thermocompressor as set forth in claim 60 wherein:

said wall thickness is less than one-tenth of the radius of the cylinder.

62. A thermocompressor as in claim 60 wherein said wall thickness is a very small fraction of the radius of the cylinder.

63. A thermocompressor as in claim 57 wherein said heating chamber inlet port is disposed in said cylindrical outer surface of said nipple, said hot bypass conduit having a mean flow axis which passes approximately through the center of said inlet port.

64. A thermocompressor as in claim 63, wherein a portion of said heating chamber inlet conduit proximate said inlet port has a mean flow axis which is approximately aligned with said mean flow axis of said hot bypass conduit.

65. A thermocompressor as in claim 57, wherein said heating means further includes a heating chamber outlet conduit extending into said nipple and communicating with said hot end of said cylinder for still further facilitating said passage of fluid in said stream into said heating chamber.

66. A thermocompressor as in claim 65 wherein said heating chamber outlet conduit communicates with said hot end of said cylinder via two separate ports in said nipple.

67. A thermocompressor as in claim 66 wherein one of said separate ports is in said cylindrical outer surface of said nipple and the other of said separate ports is in a surface of said nipple approximately facing a central portion of said piston.

68. A thermocompressor as in claim 56 wherein said heating means further includes a heating chamber outlet conduit extending into said nipple and communicating with said hot end of said cylinder for still further facilitating said passage of fluid in said stream into said heating chamber.

69. A thermocompressor as in claim 68 wherein said heating chamber inlet and outlet conduits are separate from each other in said nipple.

70. A thermocompressor as in claim 69 wherein said outlet conduit communicates with said hot cylinder end via a port in a surface of the nipple approximately facing a central portion of the piston.

71. A thermocompressor as in claim 69 wherein said outlet conduit communicates with the hot end of the cylinder via two separate ports in the hot end of the cylinder.

72. A thermocompressor as in claim 71 wherein said two separate ports are in outer surfaces of said nipple.

73. A thermocompressor as in claim 27 wherein said cylinder has a hot end-wall at the hot end of the cylinder, said hot end-wall including a nipple protruding in a direction toward the hot face of the piston, said heating chamber inlet conduit extending into said nipple such that said heating chamber inlet port is disposed in an outer surface of said nipple at a location proximate said hot bypass port.

74. A thermocompressor as set forth in claim 73 wherein: said distance between said hot bypass port and said heating chamber inlet port is less than one-tenth of the radius of the cylinder.

75. A thermocompressor as in claim 73 wherein said distance between said hot bypass port and said heating chamber inlet port is a small fraction of the radius of the cylinder.

76. A thermocompressor as in claim 73 wherein said heating means further includes a heating chamber outlet conduit extending into said nipple and communicating with said hot end of said cylinder for still further facilitating said passage of fluid in said stream into said heating chamber.

77. A thermocompressor as in claim 76 further including a groove in said outer surface of said nipple.

78. A thermocompressor as in claim 76 wherein said heating chamber outlet conduit communicates with said hot end of said cylinder via two separate ports.

79. A thermocompressor as in claim 78 wherein one port of said two separate ports is disposed in said nipple.

80. A thermocompressor as in claim 79 wherein said one port is disposed in another outer surface of said nipple, said another surface approximately facing a central portion of said piston.

81. A thermocompressor as in claim 79 wherein the second of said two separate ports is in said cylinder sidewall in said hot end of said cylinder.

* * * * *